US006076914A

United States Patent [19]

Imai

[11] Patent Number: 6,076,914

[45] Date of Patent: Jun. 20, 2000

[54] PRINT HEAD UNIT AND METHOD AND DEVICE FOR EVALUATION OF THE PRINT HEAD UNIT

[75] Inventor: Koji Imai, Nagoya, Japan

[73] Assignee: Brother Kogyo Kabushiki Kaisha, Nogoya, Japan

[21] Appl. No.: 08/933,830

[22] Filed: Sep. 19, 1997

[30] Foreign Application Priority Data

Sep. 19, 1996 [JP] Japan ..... 8-271592

[51] Int. Cl.[7] ..... B41J 29/393

[52] U.S. Cl. ..... 347/19; 347/50; 347/59; 347/211

[58] Field of Search ..... 347/14, 19, 50, 347/59, 211

[56] References Cited

U.S. PATENT DOCUMENTS 4,769,657 9/1988 Takahashi ..... 347/211

5,073,786 12/1991 Shimada et al. ..... 347/211

5,422,662 6/1995 Fukushima et al. ..... 347/211

5,642,148 6/1997 Fukushima et al. ..... 347/211

*Primary Examiner*—William Royer

*Assistant Examiner*—William A. Noe

*Attorney, Agent, or Firm*—Pollock, Vande Sande & Amernick

[57] ABSTRACT

To provide a print head unit and device and a method for evaluation of the print head unit without performing a printing operation. A current probe 21 detects a head ground current, which corresponds to a driving circuit output current. A current-voltage converter 22 converts the head ground current to a voltage level. Then, an integrating device integrates the voltage level to a waveform which corresponds to the head ground current. By comparing the produced waveform with a proper waveform one can determine, whether the print head unit is operational.

18 Claims, 8 Drawing Sheets

PRINT HEAD UNIT AND METHOD AND DEVICE FOR EVALUATION OF THE PRINT HEAD UNIT

BACKGROUND OF THE INVENTION

1. Field of the Invention

The present invention relates to a print head unit and method and device for evaluation of the print head unit.

2. Description of Related Art

A conventional method for evaluation a print head unit will be described while referring to FIGS. 1 and 2. The print head unit is evaluated to determine whether or not it can eject an ink droplet properly. A print head unit 101 is used in a printing device, and includes a print head 102, a flexible substrate 130 connected to the print head 102, and a driver IC chip 103 attached on the flexible substrate 130. The driver IC chip 103 includes a driving circuit 103*a* for driving the print head 102 and a unit interface 103*b* integrally formed with the driving circuit 103*a*. A control signal generation circuit (not shown) provided in the printing device main body generates print control signals, such as print clock signals. Such print control signals are transmitted to the driving circuit 103*a* via the unit interface 103*b*. Some of control signals such as those including print data transmitted to the driving circuit 103*a* are further transmitted to the print head 102 via the flexible substrate 130. The print head 102 is formed with an actuator 102*a*, an ink supply channel 102*b*, and a nozzle 112*a*. Ink K stored in an ink cartridge (not shown) is supplied to the actuator 102*a* through the ink supply channel 102*b*, and ejected as ink droplets from the nozzle 112*a*. In order to evaluate quality of the print head unit 101 a testing terminal 131 is provided between the print head 102 and the driving circuit 103*a* on the flexible substrate 130. The testing terminal 131 detects a waveform of a voltage outputted from the driving circuit 103*a* to the print head 102. When the quality of the print head unit 101 is satisfactory, the voltage has a normal waveform.

However, because the above-described print head unit 101 has the driving circuit 103*a* on the flexible substrate 130, its manufacturing costs are relatively high. In order to overcome this problem, there has been proposed a chip-on-head type print head unit, in which a driving circuit is provided directly on a print head without a flexible substrate therebetween. The print head and the driving circuit are connected to each other via signal lines. Manufacturing costs of this chip-on-head type of print head unit are lower than the conventional one. However, the signal lines are so delicate that a testing terminal cannot be provided on the signal lines. That is, the above-described evaluating method cannot be applied to the chip-on-head type of print head unit. As a result, in order to evaluate quality of this type of print head unit, a user needs to mount the print head unit into a printing device and perform a printing operation to print an image on a print medium. Then, the user examines the printed image and determine the quality of the print head unit.

SUMMARY OF THE INVENTION

It is an object of the present invention to overcome the above-described problems and to provide an evaluation method and an evaluation device for a print head unit capable of evaluating quality of a chip-on-head type of print head unit without performing a printing operation.

Another object of the present invention is to provide the chip-on-head type print head unit capable of undergoing evaluation by the evaluation device.

Those and other objects of the present invention will be attained by providing a print head unit including a print head, a driving circuit, a first ground line, and a second ground line. The driving circuit is directly mounted on and electrically connected to the print head. The driving circuit drives the print head. The first ground line is electrically connected to a ground and the print head. The second ground line is electrically connected to the ground and to the driving circuit.

In another aspect of the present invention, there is provided a method for evaluating a print head unit including a print head and a driving circuit for driving the print head. The driving circuit is mounted directly on and electrically connected to the print head. The method includes the steps of storing a proper voltage waveform indicative of an operational print head, in a memory, detecting a current outputted from the print head, producing a voltage waveform corresponding to the current, and comparing the produced/voltage waveform with the preset proper voltage waveform in order to determine availability of the print head unit.

In still another aspect of the present invention, there is provided a device for evaluating a print head unit including a print head and a driving circuit for driving the print head. The driving circuit is directly mounted on and electrically connected to the print head. The device includes a detector detecting a current outputted from the print head, and a producing device producing a voltage waveform corresponding to the current.

Further, in another aspect of the present invention, there is provided a combination of a print head unit and a device for evaluating the print head unit. The combination includes a print head unit and an evaluation device. The print head has a print head and a driving circuit directly mounted on the print head. The print head is electrically connected to and adapted for driving the print head. The evaluation device has a detector and a producing device. The detector detects a current outputted from the print head. The producing device produces a voltage waveform corresponding to the current.

BRIEF DESCRIPTION OF THE DRAWINGS

In the drawings:

FIG. 3(*b*) is a side view of the print head unit of FIG. 3(*a*);

DETAILED DESCRIPTION OF THE PREFERRED EMBODIMENTS

A print head unit and method and device for evaluation of the print head unit according to a preferred embodiment of the present invention will be described while referring to FIGS. 3 through 10.

A printing device for printing multicolored image on a printing medium includes a plurality of print head units. Each print head unit ejects one of a plurality of color ink.

Figure 1:
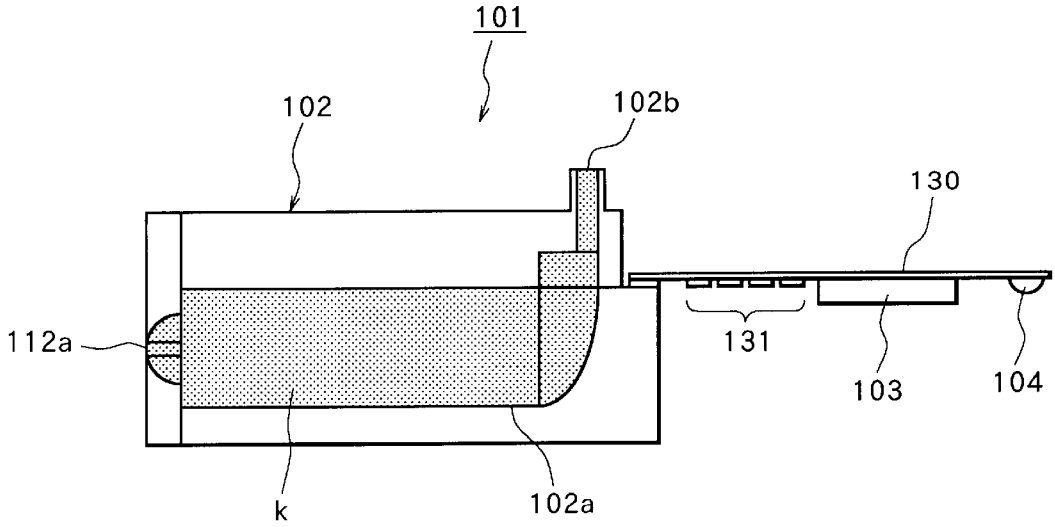
FIG. 1 RELATED ART
FIG. 1 is a cross-sectional view showing a conventional print head unit.
Figure 2:
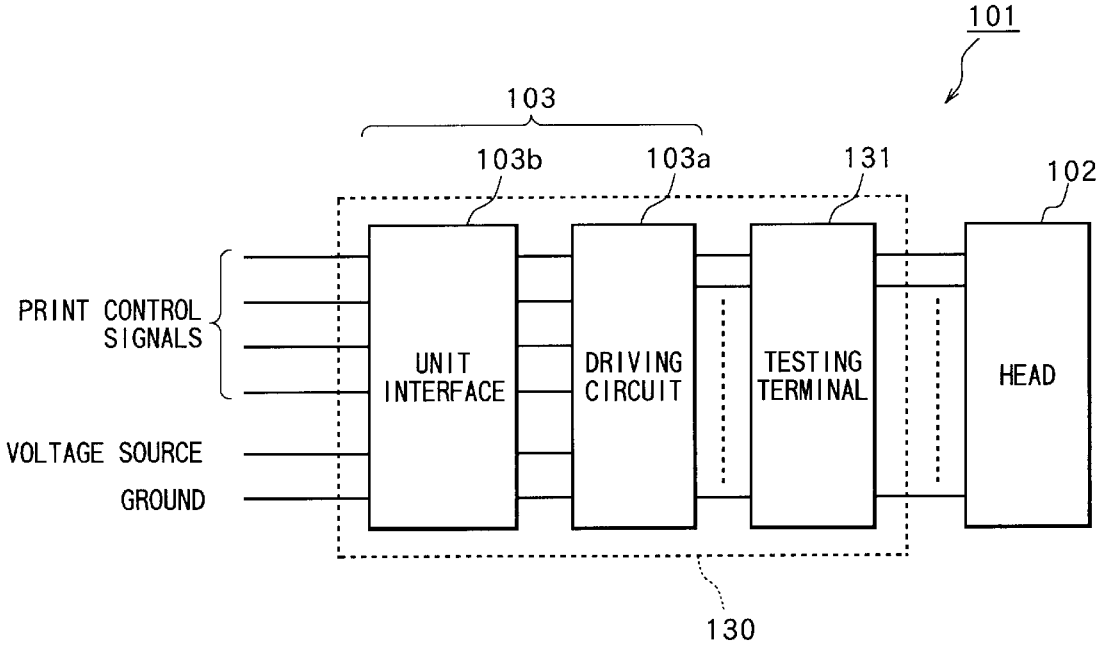
FIG. 2 RELATED ART
FIG. 2 is a block diagram showing components of the print head of FIG. 1.
Figure 3:
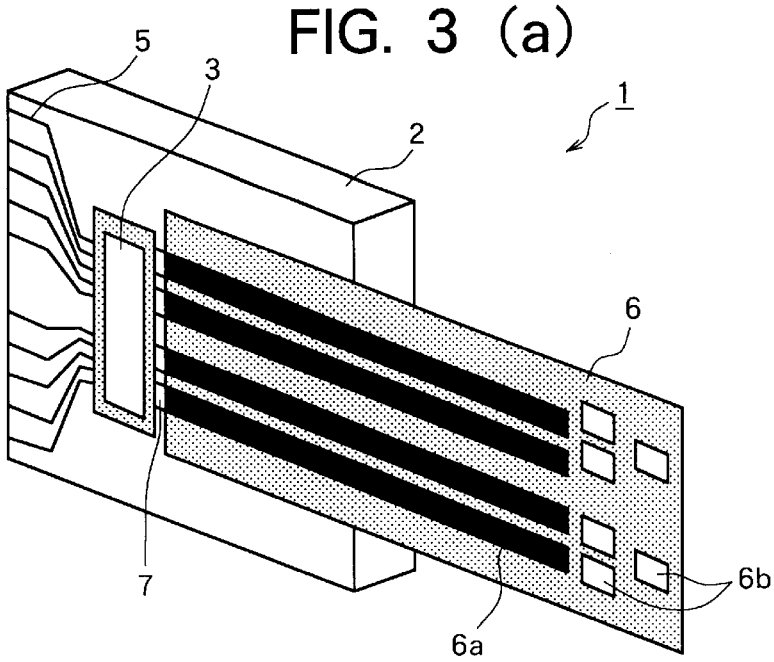
FIG. 3(*a*) is a perspective view showing a print head unit according to an embodiment of the present invention.
Figure 3:
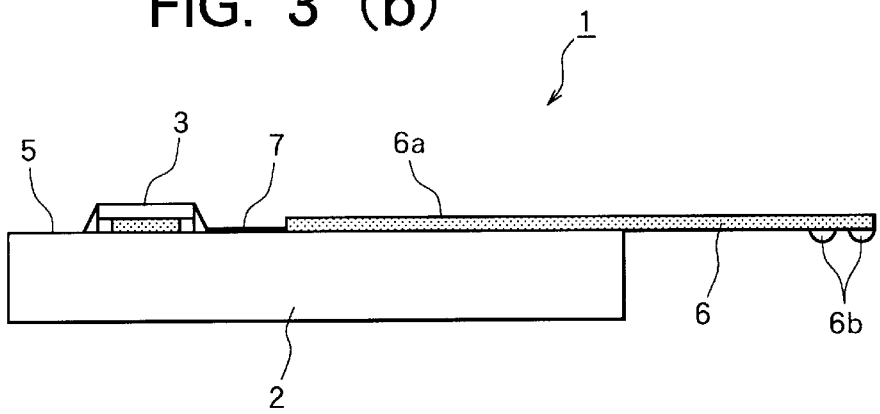

As shown in FIGS. 3(*a*), 3(*b*), and 4, a print head unit 1 includes a print head 2, a driver IC chip 3, and a flexible printing circuit (FPC) 6. Lead electrodes 5 and lead electrodes 7 are printed on a surface of the print head 2. The driver IC chip 3 is directly mounted on the print head 2 and includes a driving circuit 3*a* and a unit interface 3*b*. The driving circuit 3*a* is adapted for driving the print head 2. The driving circuit 3*a* is electrically connected to the print head 2 via the lead electrodes 5, through which print control signals are transmitted to the print head 2. Although not shown in the drawings, a printing device main body has a control unit and contacting terminals. The unit interface 3*b* is electrically connected between the driving circuit 3*a* and the control unit. To this effect, the unit interface 3*b* is connected to the FPC 6 via the lead electrodes 7. The FPC 6 has signal lines 6*a* and contact points 6*b* for contacting with the contact terminals of the printing device main body.

Figure 4:
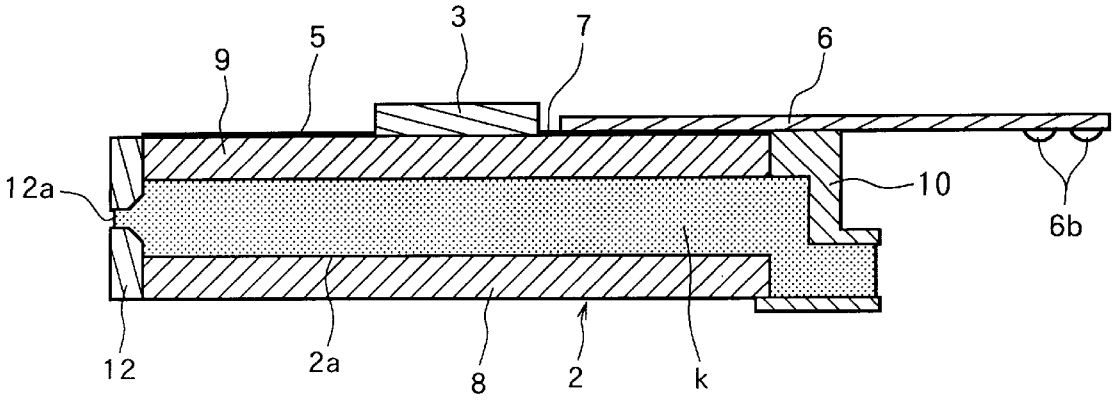
FIG. 4 is a cross-sectional view of the print head unit shown in FIG. 3(*a*)

Referring to FIG. 4, the print head 2 includes a piezoelectric element (PZT) 8, a cover plate 9, and a nozzle plate 12 formed with a nozzle 12*a*. The driver IC chip 3 and the lead electrodes 5, 7 are provided on the cover plate 9. Also, the print head 2 is formed with a channel 2*a* and a manifold 10 which are in a fluid communication with the nozzle 12. The manifold 10 serves as an ink supply opening. The channel 2*a* is filled with ink K supplied from the manifold 10. When a driving voltage is applied to the PZT 8, the PZT 8 deforms to reduce a volume of the channel 2*a*. When internal pressure of the channel 2*a* increases as a result, ink K in the channel 2*a* is ejected as an ink droplet through the nozzle 12*a* toward a print medium.

Figure 5:
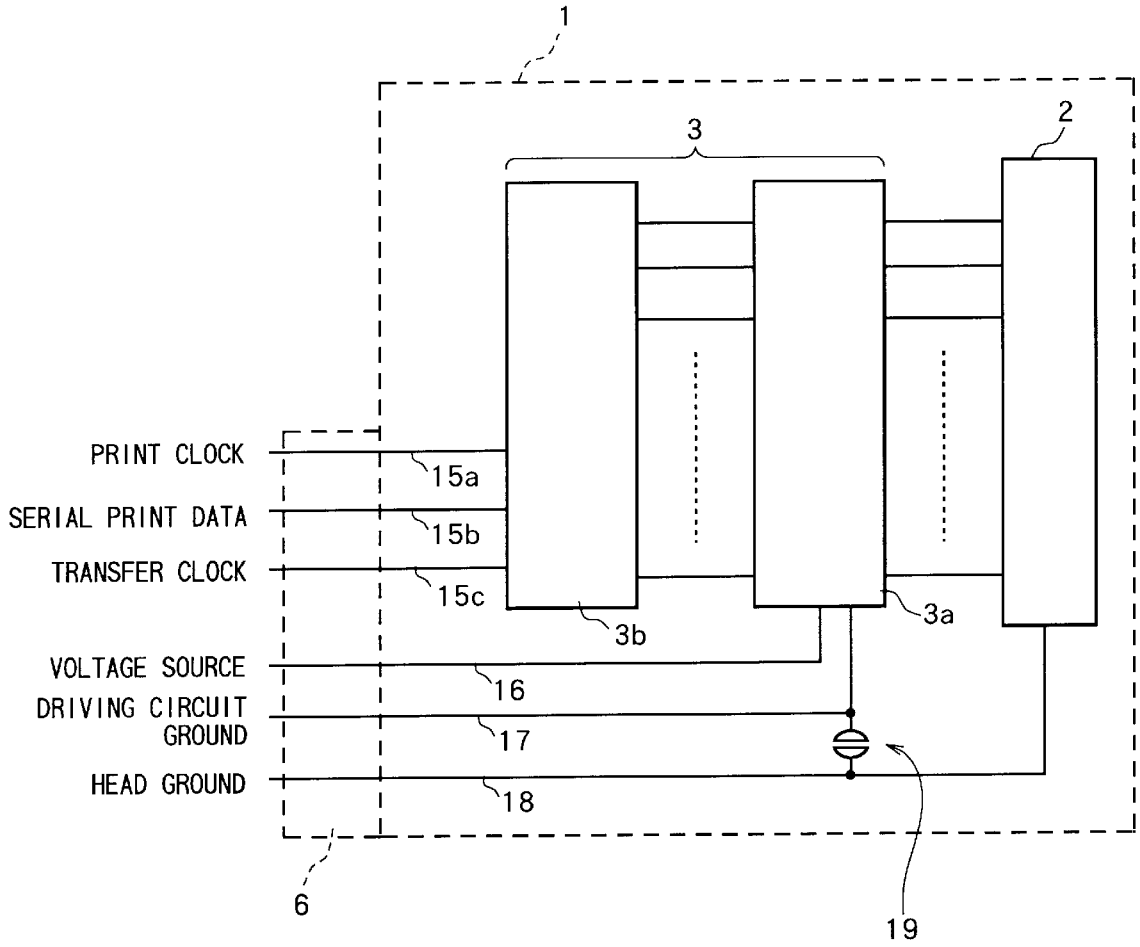
FIG. 5 is a block diagram showing an electric configuration of the print head unit according to the embodiment.

Next, an electrical configuration of the print head unit 1 will be described while referring to FIG. 5. As described above, the print head unit 1 includes the print head 2 and the driver IC chip 3 having the driving circuit 3*a* and the unit interface 3*b*. The unit interface 3*b* and the control unit of the printing device main body are electrically connected via signal lines 15*a*, 15*b*, and 15*c*, through which print clock signals, serial print data signals, and transfer clock signals, respectively, are transmitted to the unit interface 3*b*, and further to the driving circuit 3*a*. These signal lines 15*a*, 15*b*, 15*c* include the FPC signal lines 6*a*, the lead electrodes 7, and signal lines in the print head unit 1.

A voltage source is connected to the driving circuit 3*a* via a voltage source line 16 for supplying a driving voltage to the driving circuit 3*a*. Based on the signal received from the control unit, the driving circuit 3*a* controls application of the driving voltage to the print head 2 for ejecting an ink droplet. The driving circuit 3*a* and the print head 2 are connected to ground via a driving circuit ground line 17 and a head ground line 18, respectively. The driving circuit ground line 17 and the head ground line 18 extend out of the print head unit 1. A solder point 19 is provided between the driving circuit ground line 17 and the head ground line 18 and within an area of the print head unit 1. As will be described in more detail later, the solder point 19 is in a non-connected condition, that is, the lines 17 and 18 are not connected to each other, before an evaluating operation.

Figure 6:
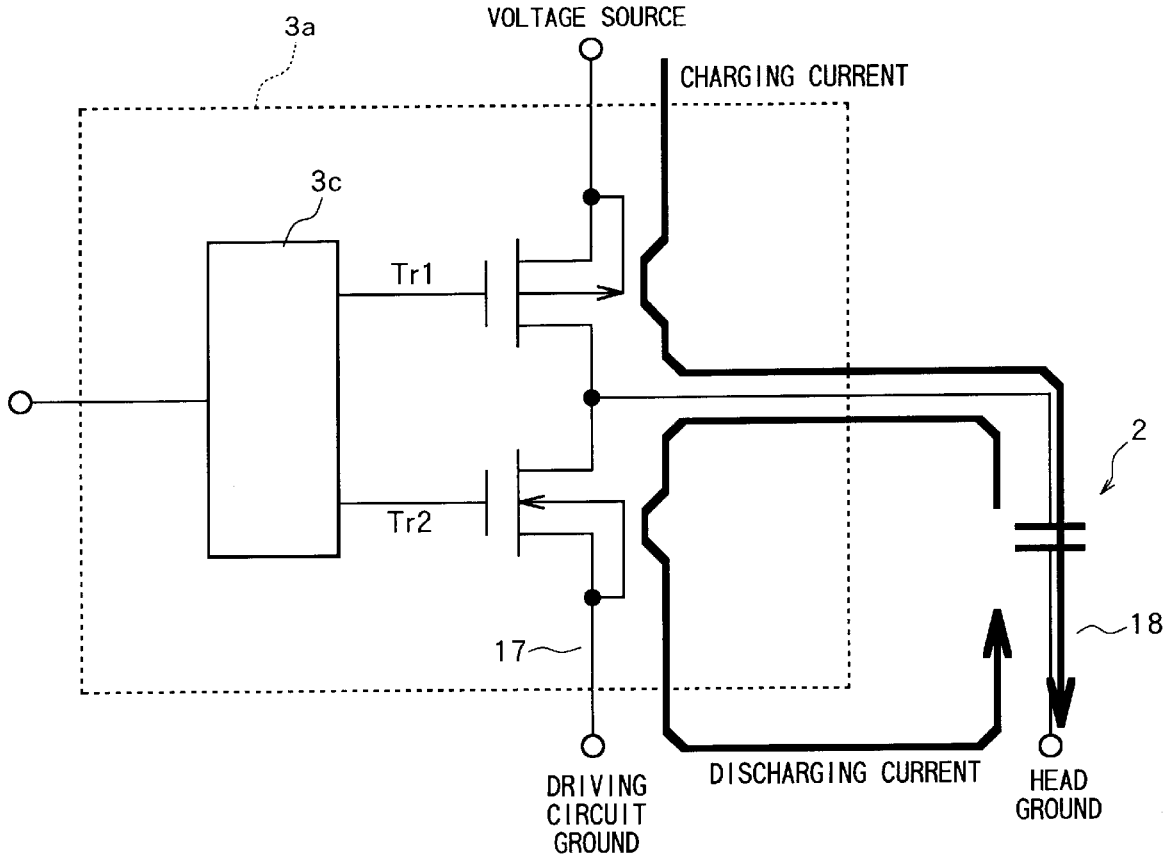
FIG. 6 is a block diagram showing an equivalent circuit of a driver circuit with respect to one channel.

Next, an equivalent circuit of the driving circuit 3*a* will be described while referring to FIG. 6. The driving circuit 3*a* includes a level converter 3*c* and FET transistors Tr1, Tr2. The transistors Tr1 and Tr2 are in a complimentary relation and electrically connected to each other at a connecting point, which is itself electrically connected through the print head 2 to the head ground line 18. The transistors Tr1 and Tr2 are rendered ON or OFF in accordance with application of a voltage outputted from the level converter 3*c*. When the transistor Tr1 is ON, that is, in a conductive state, and the transistor Tr2 is OFF, that is, in a non-conductive state, electric current flows from the voltage source through the transistor Tr1 to the print head 2, thereby charging the print head 2, which acts like a capacitor. On the other hand, when the transistor Tr1 is OFF and the transistor Tr2 is ON, charges of the print head 2 are discharged through the transistor Tr2, the driving circuit ground line 17, and the head ground line 18.

Figure 7:
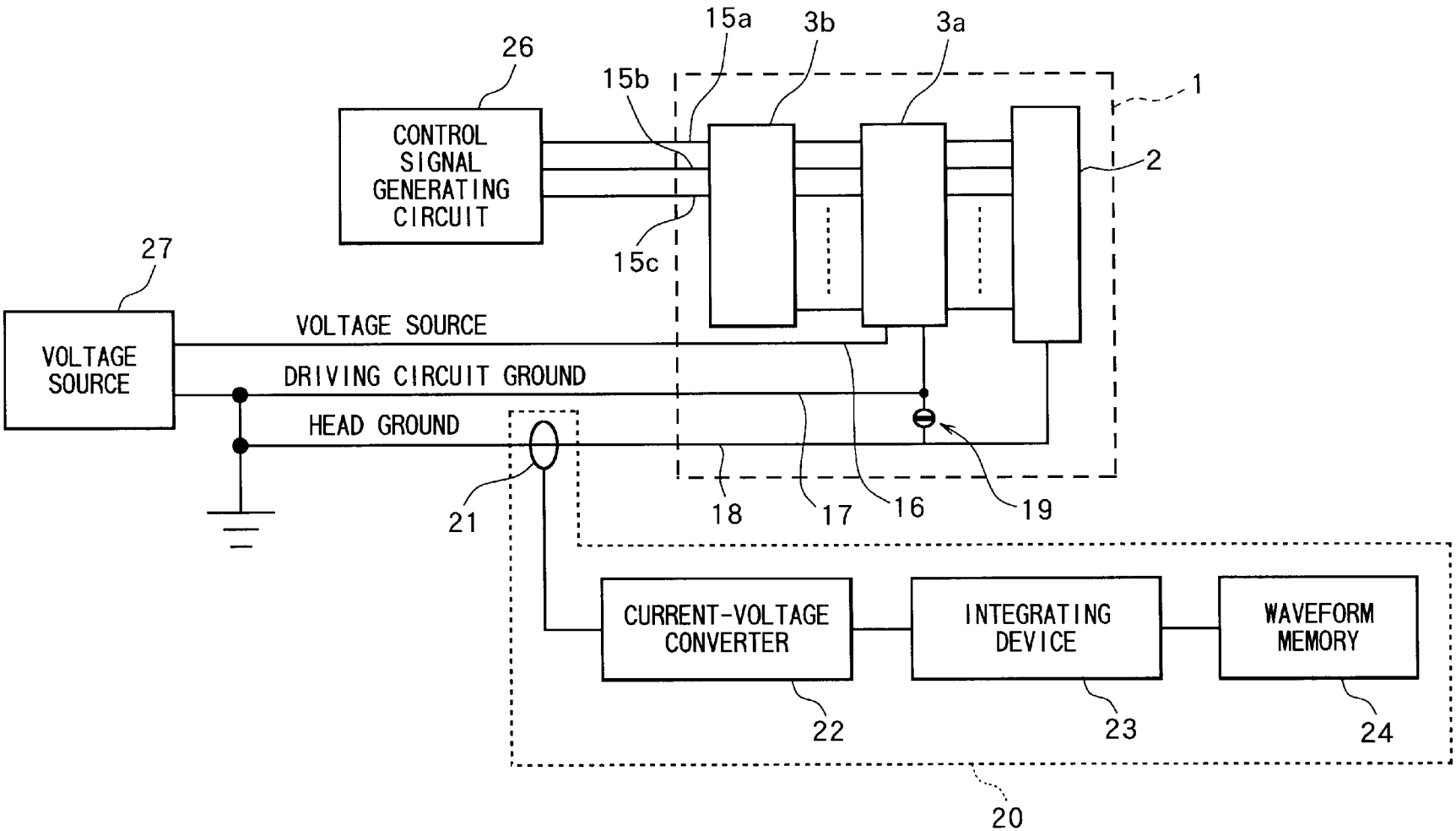
FIG. 7 is a block diagram showing electrical connection between the print head unit and an evaluation device according to the embodiment of the present invention.

Next, an evaluating device 20 for evaluating the print head unit 1 will be described while referring to FIG. 7. The evaluating device 20 detects waveform of an electric current flowing through the head ground line 18. It should be noted that even though, as described above, a testing terminal cannot be provided between the driving circuit 3*a* and the print head 2 of the chip-on-head type of printing device, a waveform of a current flowing through the head ground line 18 can be detected even after the print head unit 1 is mounted onto the main body. In this connection, instead of detection of the waveform of the electrical current output from the driving circuit 3*a* to the print head 2, the waveform of the electrical current output from the print head 2 to the ground is detected. In other words, the former waveform is predictable from the latter waveform.

The evaluating device 20 includes a current probe 21, a current-voltage converter 22, an integrating device 23, and a waveform memory 24. The current probe 21 detects an electric current flowing through the head ground line 18. The current-voltage converter 22 converts the electric current detected by the current probe 21 to a voltage level. The integrating device 23 integrates the voltage level outputted from the current-voltage converter 22 to extract its waveform. Data of the waveform is stored in the waveform memory 24.

A control signal generating circuit 26 for generating control signals is provided in the printing device main body. The control signal generating circuit 26 is electrically connected through the lines 15*a*, 15*b*, 15*c* to the interface unit 3*b* and outputs control signals thereto. The voltage source 27 is electrically connected to the driving circuit 3*a*.

Figure 8:
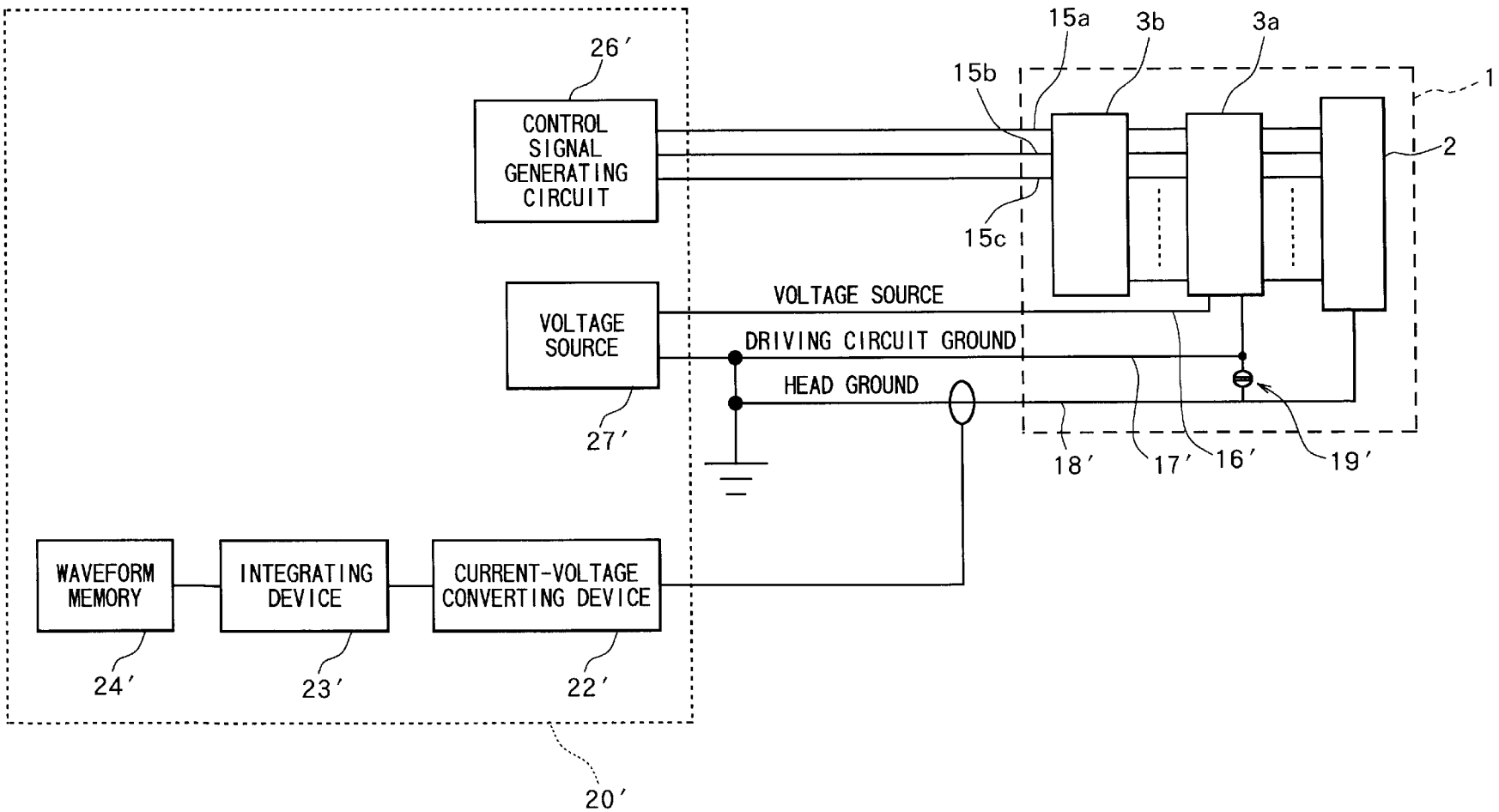
FIG. 8 is a block diagram showing electrical connection between the print head unit and a modified evaluation device.
Figure 9:
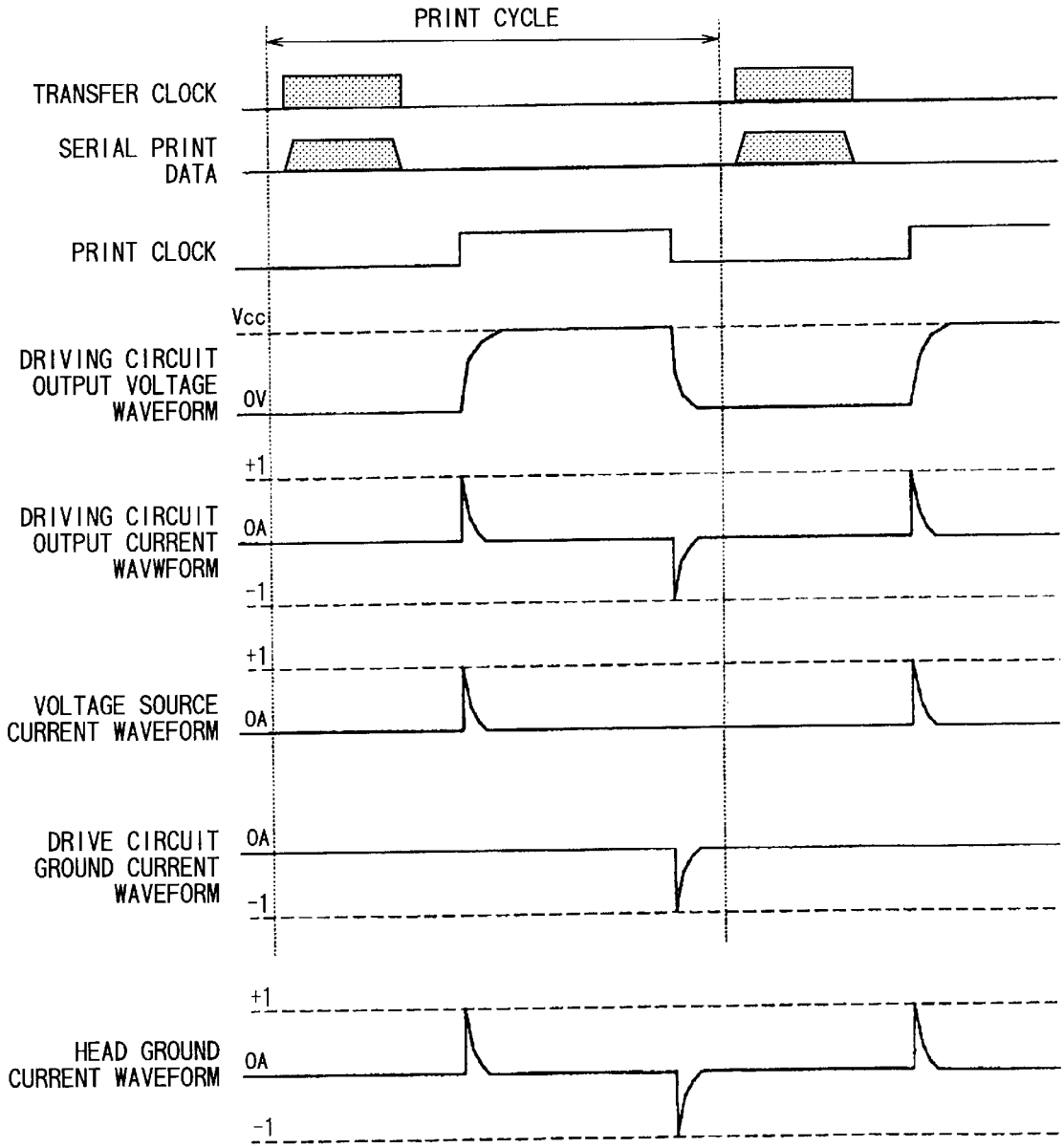
FIG. 9 shows waveforms of print control signals, voltages, and currents transmitted within the print head unit.
Figure 10:
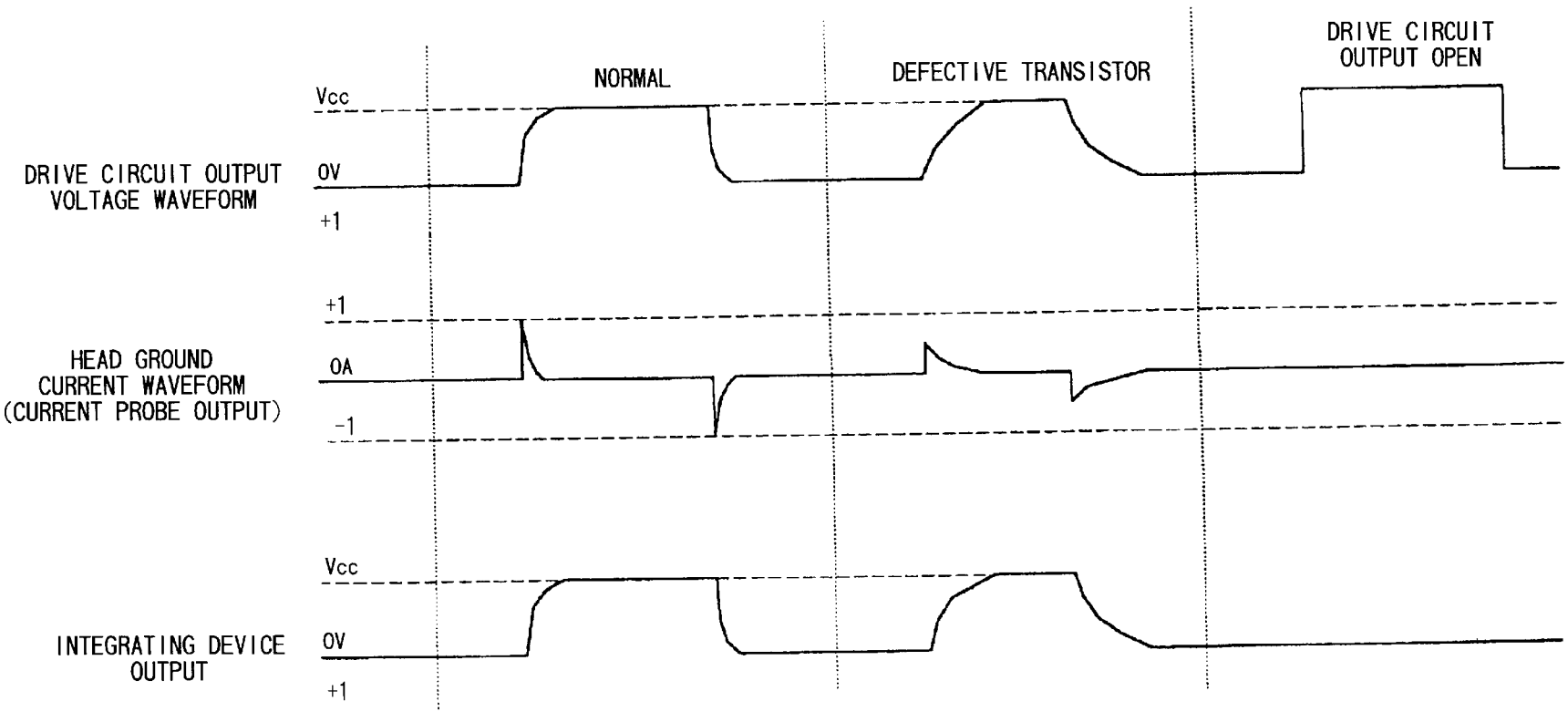
FIG. 10 is a time chart showing a driving circuit output voltage waveform, a head ground current waveform, and an integrating device output voltage waveform.

Print control signals, voltage waveforms, and current waveforms formed within the print head unit 1 will be described while referring to FIG. 9. The control signal generating circuit 26 transmits a transfer clock signal and a serial print data signal followed by a print clock signal to the driving circuit 3*a*. With the rising edge of the print clock signal, the transistor Tr1 of the driving circuit is rendered ON, and the transistor Tr2 is rendered OFF. The electric current flows from the voltage source 27 through the driving circuit 3*a* to the print head 2, thereby charging the print head 2. On the other hand, with the lowering edge of the print clock signal, the transistor Tr1 is rendered OFF, and the transistor Tr2 is rendered ON. The charges in the print head 2 are then discharged through the driving circuit 3*a*. In accordance with rising and falling edges of the print clock signal, waveform of a voltage outputted from the driving circuit (driving circuit output voltage waveform), waveform of a current outputted from the driving circuit (driving circuit output current waveform), waveform of a current outputted form the voltage source (voltage source current waveform), and waveform of a current flowing through the driving circuit ground line 17 (driving circuit ground current waveform) are formed as shown in FIG. 8. In the present embodiment, the driving circuit ground line 17 and the head ground line 18 are provided separately. Therefore, the current probe 21 can detect electric currents flowing through the head ground line 18 both when charging the print head 2 and discharging the charges in the print head 2.

Next, an evaluation method of the print head unit 1 using thus configured evaluation device will be described while referring to FIG. 9. Whether or not quality of the print head unit 1 is satisfactory is ideally determined based on the driving circuit output voltage waveform which can be obtained from the driving circuit output current waveform. When the solder point 19 is non-connected as shown in FIG. 5, the waveform of current flowing through the head ground line 18 (head ground current waveform) has the same pattern as the driving circuit output current waveform as shown in FIG. 9. Therefore, provided that the driving circuit output voltage waveform can not be easily detected for geometrical reasons, the driving circuit output voltage waveform can be predicted based on the head ground current waveform.

First, the print head unit 1 is mounted onto the main body, and the driving circuit 3*a* drives the print head 2. Then, as shown in FIG. 7, the current probe 21 detects the head ground current. The current-voltage converter 22 detects the voltage level of the current. The integrating device 23 integrates the voltage level in order to output the driving circuit output voltage waveform. Data of the driving circuit output voltage waveform is stored in the waveform memory 24. Then, the waveform is compared with a proper or normal waveform (FIG. 10) which a properly operational print head unit should have. These waveforms can be compared and whether or not the quality of the detected waveform is satisfactory can be determined either by an operator or automatically by a computer. If the quality of the print head unit 1 is determined to be unsatisfactory, the print head unit 1 is dismounted from the main body and replaced by another one.

After the evaluation operation, solder is applied to the solder points 19 to connect the two separate portions so that electric current can be prevented from flowing out of the print head unit 1 during normal printing operations.

In the embodiment described above, the user need not perform the printing operation in order to evaluate the quality of the print head unit 1.

When driving the print head 2 including the PZT 8, a sufficient amount of current flows through the ground lines 17, 18. Therefore, it is especially advantageous to utilize the device and method of the present invention to examine the print head unit including a piezoelectric element.

Also, the evaluating operation is performed for each of the plurality of print head units. When a print head unit can be established to have poor quality, only the poor quality print head unit is disposed of, instead of a whole set of print head units, and therefore, it is economical.

FIG. 8 shows an evaluation device 20' according to another embodiment. In the evaluation device 20 shown in FIG. 7, the control signal generation circuit 26 and the voltage source 27 are provided in the main body of the printing device. Therefore, for the evaluation, the print head unit 1 must be installed in the main body. The modified evaluation device 20' pertains to an improvement on the first embodiment in that the evaluation can be made without installation of the print head unit 1 onto the main body. The evaluation device 20' includes a control signal generating circuit 26' and a voltage source 27' in addition to a current-voltage converter, 22' an integrating device 23', and a waveform memory 24'. When the print head unit 1 is evaluated, control signals and a driving voltage can be supplied along line 16' from the control signal generating circuit 26' and a voltage source 27'. Ground lines are indicated at 17' and 18'. In this case, the print head unit 1 can be evaluated without being mounted onto the main body. Therefore, if the quality of the print head unit is determined to be unsatisfactory, it is unnecessary to dismount the print head unit 1 from the main body. It is less time consuming and further increases evaluation efficiency.

While the invention has been described in detail with reference to specific embodiments thereof, it would be apparent to those skilled in the art that various changes and modifications may be made therein without departing from the spirit of the invention.

For example, in the above-described embodiment, the solder point 19 is connected after the evaluation operation. However, the print head unit 1 can be configured so that even if electric current flowing through the ground lines drains out of the print head unit 1 at a normal print operation, such electric current causes no drawback. In this case, the solder point 19 can be left in a disconnected state even after the evaluation operation has been completed.

What is claimed is:

1. A print head unit comprising:

a print head;

a driving circuit directly mounted on the print head and electrically connected to the print head for driving the print head;

a first ground line having one end electrically connected to a ground and another end electrically connected to the print head; and a second ground line having one end electrically connected to the ground and another end electrically connected to the driving circuit.

2. The print head unit according to claim 1, further comprising one solder point provided on the first ground line and another solder point provided on the second ground line, those solder points being electrically connectable by soldering.

3. The print head unit according to claim 1, wherein the print head comprises a piezoelectric member forming an ink channel.

4. A method for evaluating a print head unit including a print head and a driving circuit mounted directly on the print head and electrically connected to the print head for driving the print head, the method comprising the steps of:

storing a proper voltage waveform indicative of an operational print head unit in a memory;

detecting a current outputted from the print head;

generating a voltage waveform corresponding to the current; and comparing the generated voltage waveform with the proper voltage waveform in order to determine whether the print head unit operates properly.

5. The method according to claim 4, wherein the generating step comprises the steps of:

converting the current to a voltage level;

integrating the voltage level to obtain the voltage waveform; and storing the voltage waveform in a memory.

6. The method according to claim 4, the print head unit further including a first ground line having one end electrically connected to a ground and another end electrically connected to the print head and a second ground line having one end electrically connected to the ground and another end electrically connected to the driving circuit, the method further comprising the step of electrically connecting the first ground line and the second ground line after the comparing step.

7. A device for evaluating a print head unit including a print head, a driving circuit directly mounted on the print head and electrically connected to the print head for driving the print head, the device comprising:

a detector for detecting a current outputted from the print head, and a producing device for producing a voltage waveform corresponding to the current.

8. The device according to claim 7, wherein the producing device comprises a converter connected to the detector for converting the current to a voltage level, and an integrator connected to the converter for integrating the voltage level to obtain a voltage waveform.

9. The device according to claim 7, wherein the producing device further comprises a memory for storing the voltage waveform.

10. The device according the claim 7, further comprising a control signal generating circuit connected to the print head unit for generating control signals and outputting the control signals to the print head unit, and a voltage source connected to the driving circuit of the print head unit for supplying a driving voltage to the driving circuit.

11. A combination of a print head unit and an evaluation device for evaluating the print head unit, the combination comprising:

a print head unit comprising a print head and a driving circuit directly mounted on the print head and electrically connected to the print head for driving the print head; and an evaluation device comprising a detector for detecting a current outputted from the print head, and a producing device for producing a voltage waveform corresponding to the current.

12. The combination according to claim 11, wherein the producing device comprises a converter connected to the detector for converting the current to a voltage level, and an integrator connected to the converter for integrating the voltage level to obtain a voltage waveform, wherein the evaluation device further comprises a memory for storing the voltage waveform.

13. The combination according to claim 12, wherein the print head unit further comprises a first ground line having one end electrically connected to a ground and another end electrically connected to the print head, and a second ground line having one end electrically connected to the ground and another end electrically connected to the driving circuit.

14. The combination according to claim 13, wherein the detector detects a current flowing through the first ground line.

15. The combination according to claim 13, wherein the print head unit further comprises one solder point provided on the first ground line and another solder point provided on the second ground line, those solder points being electrically connectable by soldering.

16. The combination according to claim 11, wherein the evaluation device further comprises a control signal generating circuit connected to the print head unit for generating control signals and outputting the control signals to the print head unit, and a voltage source connected to the driving circuit of the print head unit for supplying a driving voltage to the driving circuit.

17. The combination according to claim 16, wherein the print head unit further comprises an interface electrically connected to the driving circuit, and the control signal generating circuit is electrically connected to the interface and outputs the control signals to the interface.

18. The combination according to claim 11, wherein the print head comprises a piezoelectric member forming an ink channel.

* * * * *